United States Patent [19]

Hetzel et al.

[11] Patent Number: 4,865,520

[45] Date of Patent: Sep. 12, 1989

[54] MARINE PROPELLER WITH ADDENDUM

[75] Inventors: Robert H. Hetzel; Stephan R. Konrad, both of Oshkosh, Wis.

[73] Assignee: Brunswick Corporation, Skokie, Ill.

[21] Appl. No.: 254,465

[22] Filed: Oct. 6, 1988

[51] Int. Cl.[4] ..... B63H 1/26

[52] U.S. Cl. ..... 416/236 R; 416/237

[58] Field of Search ..... 416/237, 236 A, 236 R, 416/235

[56] References Cited

U.S. PATENT DOCUMENTS

| | | | |
|---|---|---|---|
| 395,538 | 1/1889 | Biduald | 416/237 |
| 408,864 | 8/1889 | Vogelgesang | 416/237 X |
| 1,190,755 | 7/1916 | Hahn | 416/237 X |
| 2,357,084 | 8/1944 | Cleofe | 416/235 |
| 3,065,723 | 11/1962 | Tulin | 416/237 X |
| 3,077,173 | 2/1963 | Lang | 416/237 X |
| 4,552,511 | 11/1985 | Sumigawa | 416/237 X |

FOREIGN PATENT DOCUMENTS

| | | | |
|---|---|---|---|
| 2626304 | 12/1976 | Fed. Rep. of Germany | 416/237 |

OTHER PUBLICATIONS

"Everything You Need To Know About Propellers", Mercury Marine Division, Brunswick Corporation, 1984, QS5-384-10M, Part No. 90-86144.

"Marine Applications of Titanium And Its Alloys", Titanium Metals Corporation of America, 195 Clinton Road, West Caldwell, N.J. 07006, Nov. 29, 1968.

*Primary Examiner*—Robert E. Garrett

*Assistant Examiner*—Joseph M. Pitko

*Attorney, Agent, or Firm*—Andrus, Sceales, Starke & Sawall

[57] ABSTRACT

A marine propeller (4) has a plurality of blades (12, 13, 14, and 15) each with an integral addendum (34) extending rearwardly from the trailing edge (30) of the positive pressure surface (26) of the blade. A particular combination of blade area ratio and blade rake is provided to enable quick acceleration to a high-speed on-plane condition in blade surfacing racing applications, and without bobbing up and down. The blade area ratio is at least 40%, and the blade rake is 10° to 25°.

13 Claims, 3 Drawing Sheets

MARINE PROPELLER WITH ADDENDUM

FIELD OF INVENTION

The invention arose during development efforts directed toward racing performance marine propellers.

PRIOR ART

Marine propellers with addendums are known in the art. An addendum extends integrally rearwardly from the propeller blade. In one known configuration, the front surface of the addendum is recessed from the positive pressure surface of the blade and forms a transition angle therewith. The addendum has a trailing edge which is sharp and crisp for best performance, but is also highly stressed, with fatigue cracks starting from such sharp trailing edge. For added strength, the cross sectional thickness of the blade is increased at the noted transition angle which is at the forward end of the addendum. This in turn may enable the pitch of the front surface of the addendum leading rearwardly from such transition angle to be less than the pitch of the positive pressure surface of the blade at the leading edge thereof. The negative pressure surface of the blade extends rearwardly and merges with the back surface of the addendum along a smooth contour. Blade rake is about 5°.

The noted prior art blade and addendum configuration has been unsatisfactory for blade surfacing racing applications. The boat does not attain sufficient speed to reach an on-plane condition. Furthermore, the boat tends to bob up and down, with the oscillation becoming more pronounced the higher the speed.

SUMMARY OF INVENTION

The present invention provides a marine propeller with a blade and addendum combination overcoming the above noted problems. It is believed that the recing failure of the above noted prior art design is due to a combination of improper blade area ratio and rake. The present invention involves a propeller blade and addendum combination with particular blade area ratio and rake ranges.

The invention also extends the life of the propeller by minimizing stress at the trailing edge to minimize fatigue cracks therefrom.

DETAILED DESCRIPTION

Figure 1:
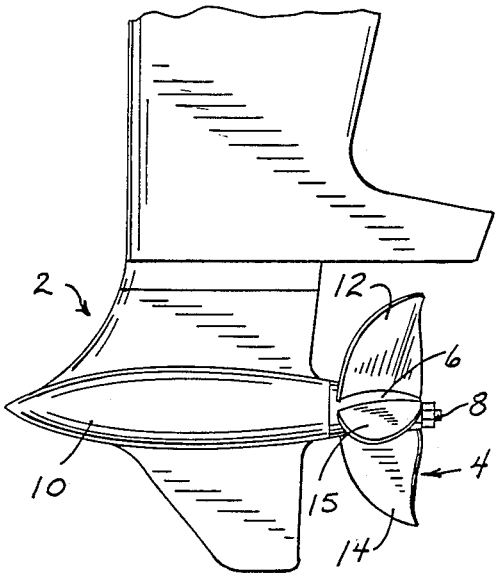
FIG. 1 is a side elevation view of a racing marine lower drive unit with a propeller.
Figure 2:
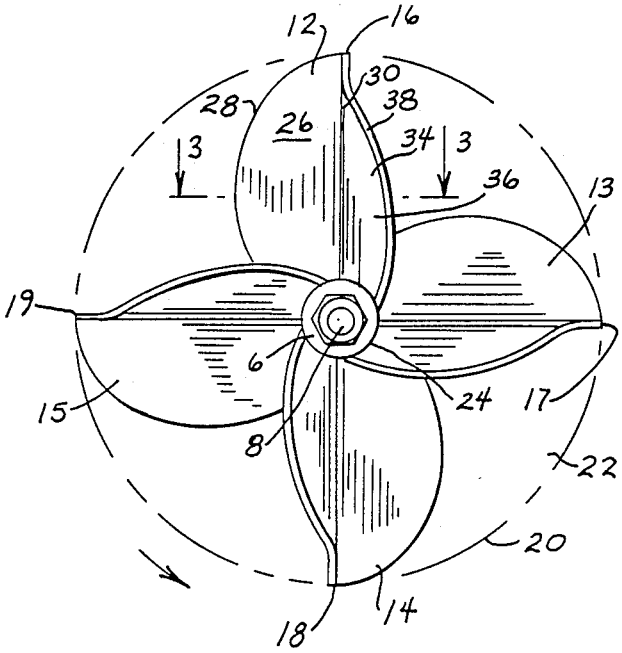
FIG. 2 is an end elevation view of the propeller of FIG. 1 from the rear.

FIG. 1 shows a marine lower drive unit 2 having a propeller 4 with a hub 6 mounted on a propeller shaft 8, FIG. 2, extending from torpedo housing 10. Propeller hub 6 has a plurality of cleaver blades 12, 13, 14, and 15 extending generally radially outwardly therefrom to respective outer tips 16, 17, 18 and 19. Cleaver blades are known in the art, for example as shown in "Everything You Need To Know About Propellers", Mercury Marine Division, Brunswick Corporation, 1984, QS5-384-10M, Part No. 90-86144, page 18. In the preferred embodiment, the propeller has four blades, though other numbers of blades are possible, including three blade propellers. The outer tips 16–19 define a circle during rotation of the propeller, which circle has a circumference 20, shown in dashed line, spaced radially outwardly of hub 6 by an annulus 22 through which the blades move. Annulus 22 has an outer circumference 20 at the outer tips of the blades, and an inner cicumference 24 at the inner root ends of the blades where they meet hub 6.

Figure 3:
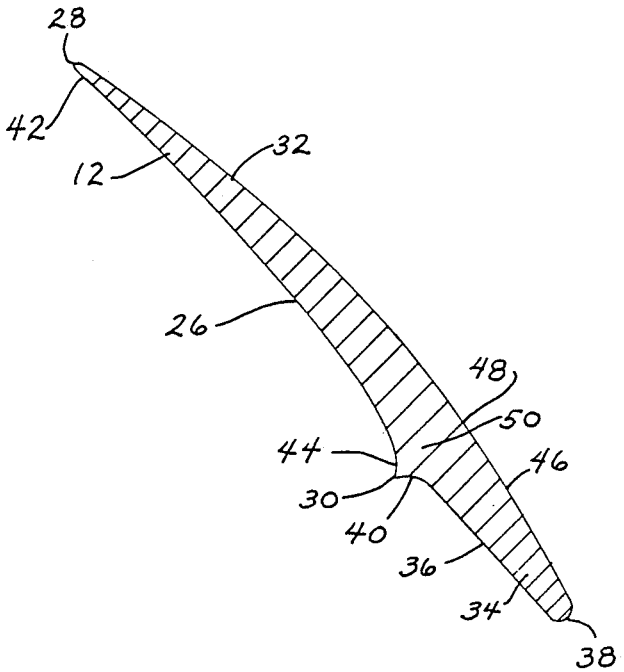
FIG. 3 is a sectional view taken along line 3—3 of FIG. 2.
Figure 4:
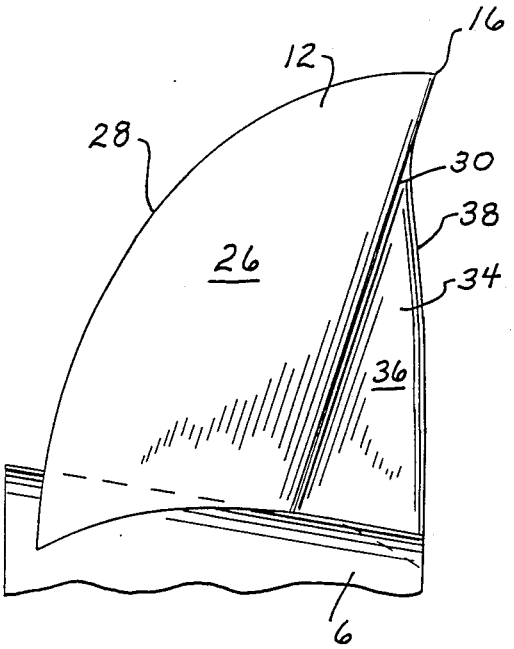
FIG. 4 is a side elevation view of one of the blades of the propeller of FIG. 1 showing the positive pressure surface.
Figure 5:
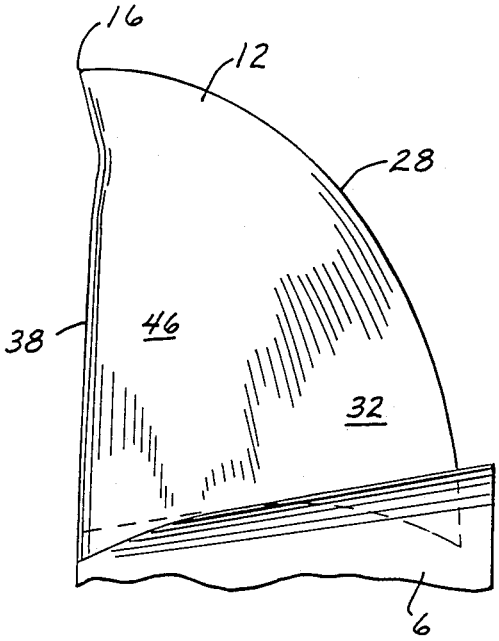
FIG. 5 is a view like FIG. 4 but shows the other side of the blade, namely the negative pressure surface.
Figure 6:
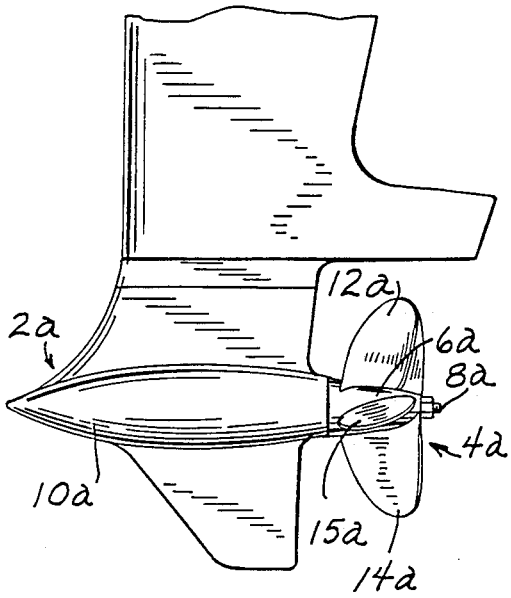
FIG. 6 is a view like FIG. 1 and shows an alternate embodiment.
Figure 7:
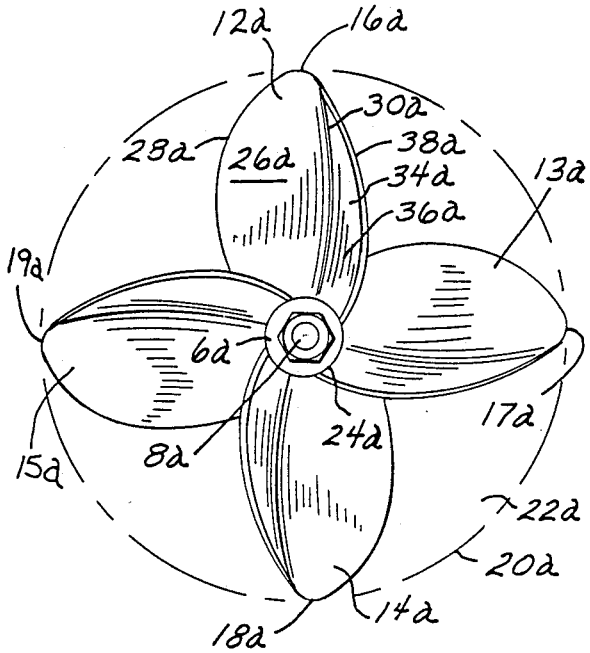
FIG. 7 is an end elevation view of the propeller of FIG. 6 from the rear.
Figure 8:
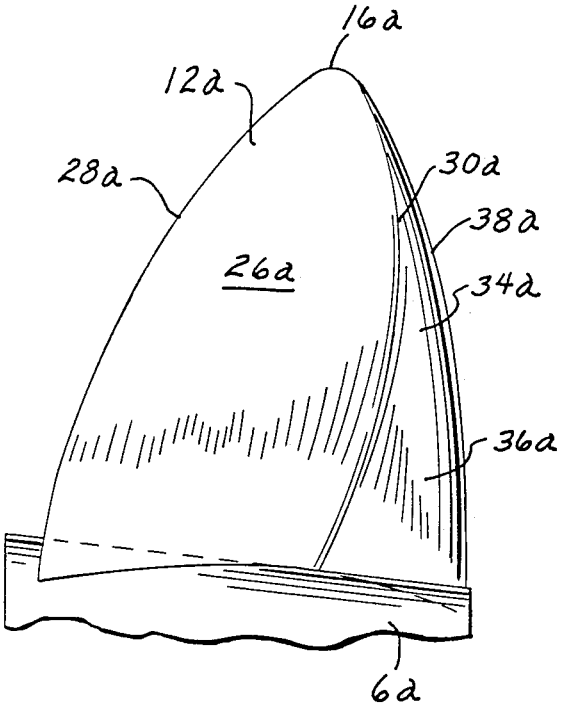
FIG. 8 is a side elevation view of one of the blades of the propeller of FIG. 6 showing the positive pressure surface.
Figure 9:
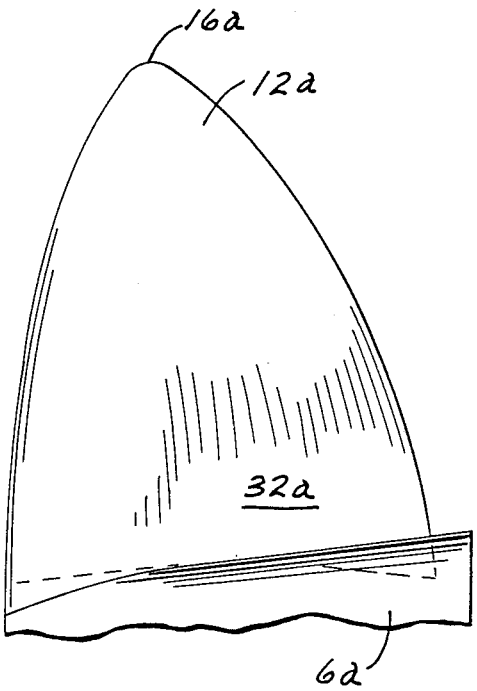
FIG. 9 is a view like FIG. 8 but shows the other side of the blade, namely the negative pressure surface.

Blades 12–15 are identical, one of which will now be described in detail. Blade 12 has a positive pressure surface 26, FIG. 3, with a forward leading edge 28 and a rearward trailing edge 30. These terms are used according to their normal usage and understanding in the art, and for which further reference may be had to the above noted "Everything You Need To Know About Propellers", Mercury Marine. As the propeller rotates counter-clockwise as viewed in FIG. 2, water is pushed rearwardly, which is rightwardly in FIG. 1, resulting in positive pressure. At the same time, water is being drawn to the other side 32 of the blade, resulting in negative pressure. Surface 32 is called the negative pressure surface of the blade. The noted action occurs on all blades which are submerged, as the propeller rotates. Negative pressure pulls the propeller along, while positive pressure pushes it along, all as described in the above noted "Everything You Need To Know About Propellers", Mercury Marine, pages 3 and 4. Reference is also made to copending allowed U.S. application Ser. No. 07/106,140, filed October 8, 1987, entitled "Marine Propeller With Optimized Performance Blade Contour", incorporated herein by reference.

Blade 12 has an integral addendum 34 extending rearwardly from trailing edge 30. Addendum 34 has a front surface 36, FIG. 3, facing generally in the same direction as positive pressure surface 26 of the blade and recessed from surface 26 and forming a transition angle therewith at edge 30. Addendum 34 has a rounded non-sharp trailing edge 38 spaced rearwardly of edge 30. Front surface 36 of addendum 34 extends rearwardly at section 40 from the transition angle at edge 30 at a pitch less than or equal to the pitch of positive pressure surface 36 of the blade at section 42 at leading edge 28. As known in the art, blade pitch is the distance that a propeller would move in one revolution if it were traveling through a soft solid, like a screw in wood. The higher the pitch, the more axial movement of the propeller or screw per revolution, for which further reference may be had to the above noted "Everything You Need To Know About Propellers", Mercury Marine, page 6. Positive pressure surface 26 is cupped at rear section 44 at trailing edge 30, to increase pitch, for which further reference may be had to the above noted "Everything You Need To Know About Propellers", Mercury Marine, pages 8 and 9.

Negative pressure surface 32 of the blade faces oppositely of positive pressure surface 26. Addendum 34 has a back surface 46 facing generally in the same direction as negative pressure surface 32 and extending rearwardly therefrom and merging along a smooth contour 48. The macimum thickness of blade 12 between positive pressure surface 26 and negative pressure surface 32, and of addendum 34 between front surface 36 and back surface 46, is at section 50 between surface 48 and edge 30.

In operation, the recessing of front surface 36 of addendum 34 away from positive pressure surface 26 of the blade and the low pitch at addendum front surface section 40 enhances acceleration of the boat at high angles of attack, i.e. high propeller rotational speed, low boat speed. When the propeller blades reach a low angle of attack, i.e. high propeller speed, high boat speed, water detaches from the addendum front surface 36, and the propeller blades operate at the optimum designed pitch and blade area as if the addendum were not present, i.e. only surface 26 is the effective high pressure surface, not surface 36. On the other side of the blade along negative pressure surface 32, the added negative pressure surface along back surface 46 of the addendum provides additional braking during deceleration. Also, the addition of the addendum increases blade cord length for added strength, without increasing the effective positive pressure surface area 26 of the blade.

In the present invention, there is provided a particular blade area ratio in combination with a particular blade rake. Blade area ratio is the cummulative area of the positive pressure surfaces of the blades, excluding the front surfaces of the addendums, as a percentage of the total area of annulus 22. In the preferred embodiment, this ratio is 50% or greater, i.e. the cummulative area of the positive pressure surfaces such as 26 of the blades, excluding the front surfaces such as 36 of the addendums, is at least 50% of the total area of annulus 22. The blade area ratio may be as low as 40%, though 50% is preferred for optimum propeller surfacing racing performance. In other embodiments using a three blade propeller, the blade area ratio should be at least 45%. Blade rake is the angle of slant-back of the blade when viewing the blade on a cut extending directly through the center of the hub, for which further reference may be had to the above noted "Everything You Need To Know About Propellers", Mercury Marine, page 7. In the preferred embodiment of the present invention, blade rake is about 15°, though the rake may be in the range of about 10° to 25°.

In the above noted prior art design, the blade area ratio was about 30% to 35%, and the blade rake was about 5°. It is believed that these two factors in combination contributed to failure of such prior art design in blade surfacing racing applications. In the present invention, with the noted combination of blade area ratio and rake, the boat accelerated quickly to high speed and an on-plane condition, and without the above noted problems of bobbing up and down of the noted prior art design.

In the present invention, an additional advantage is provided by moving the effective sharp trailing edge toward the center of the blade at 30 in combination with forming a rounded non-sharp edge at ineffective trailing edge 38 of the addendum. This eliminates the otherwise sharp trailing edge where fatigue cracks start. This in turn extends the life of the propeller.

FIG. 6–9 correspond respectively to FIGS. 1, 2, 4 and 5, and show an alternate embodiment round blade design, and use like reference numerals but with the subscript "a" to facilitate clarity. Marine propeller drive unit 2a has propeller 4a with hub 6a mounted on propeller shaft 8a extending from torpedo housng 10a. Propeller hub 6a has a plurality of rounded blades 12a, 13a, 14a and 15a extending generally radially outwardly therefrom to respective outer tips 16a, 17a, 18a and 19a. Though four blades are shown, other numbers of blades are possible, including three blade propellers. Outer tips 16a–19a define a circle during rotation of the propeller, which circle has a circumference 20a, shown in dashed line, spaced radially outwardly of hub 6a by an annulus 22a through which the blades move. Annulus 22a has an outer circumference 20a at the tips of the blades, and an inner circumference 24a at the inner root ends of the blades where they meet hub 6a.

Blades 12a–15a are identical, one of which will now be described in detail. Blade 12a has a positive pressure surface 26a with a forward leading edge 28a and a rearward trailing edge 30a. Surface 32a is the negative pressure surface of the blade. Blade 12a has an integral addendum 34a extending rearwardly from trailing edge 30a. Addendum 34a has a front surface 36a facing generally in the same direction as positive pressure surface 26a of the blade and recessed from surface 26a and forming a transition angle therewith at edge 30a. Addendum 34a has a rounded nonsharp trailing edge 38a spaced rearwardly of edge 30a.

In FIGS. 6–9, the blade area ratio is preferably at least 50%, i.e. the cummulative area of the positive pressure surfaces such as 26a of the blades, excluding the front surfaces such as 36a of the addendums, is at least 50% of the total area of annulus 22a. The blade area ratio may be as low as 40%, though 50% is preferred for optimum propeller surfacing racing performance. In other embodiments using a three blade propeller, the blade area ratio should be at least 45%. Blade rake is preferably about 15°, though the rake may be in the range of about 10° to 25°. The effective sharp trailing edge is moved toward the center of the blade at 30a, and a rounded non-sharp edge is provided at ineffective trailing edge 38a of the addendum. This eliminates the otherwise sharp trailing edge where fatigue cracks start, which in turn extends the life of the propeller.

It is recognized that various equivalents, alternatives and modifications are possible within the scope of the appended claims.

We claim:

1. A marine propeller comprising a hub having a plurality of blades extending generally radially outwardly therefrom to respective outer tips defining a circle during rotation of said propeller, said circle having a circumference spaced radially outwardly of said hub by an annulus through which said blades move, said annulus having an outer circumference at said blade tips defining said circumference of said circle, said annulus having an inner circumference at inner root ends of said blades where they meet said hub, each blade having a positive pressure surface with a forward leading edge and a rearward trailing edge, each blade having an integral addendum extending rearwardly from said trailing edge, said addendum having a front surface facing generally in the same direction as said positive pressure surface of said blade and recessed from the latter and forming a transition angle therewith at said trailing edge, the blade area ratio being at least 40%, namely the cummulative area of said positive pressure surfaces of said blades, excluding said front surfaces of said addendums, being at least 40% of the total area of said annulus.

2. The invention according to claim 1 consisting of four said blades.

3. The invention according to claim 1 consisting of three said blades, and wherein said blade area ratio is at least 45%.

4. The invention according to claim 1 wherein said blade area ratio is at least 50%.

5. A marine propeller comprising a hub having a plurality of blades extending generally radially outwardly therefrom to respective outer tips, each blade having a positive pressure surface with a forward leading edge and a rearward trailing edge, each blade having an integral addendum extending rearwardly from said trailing edge, said addendum having a front surface facing generally in the same direction as said positive pressure surface of said blade and recessed from the latter and forming a transition angle therewith at said trailing edge, said blades having a rake of 10° to 25°.

6. The invention according to claim 5 wherein said blade rake is about 15°.

7. A marine propeller comprising a hub having a plurality of blades extending generally radially outwardly therefrom to respective outer tips defining a circle during rotation of said propeller, said circle having a circumference spaced radially outwardly of said hub by an annulus through which said blades move, said annulus having an outer circumference at said blade tips defining said circumference of said circle, said annulus having an inner circumference at inner root ends of said blades where they meet said hub, each blade having a positive pressure surface with a forward leading edge and a rearward trailing edge, each blade having an integral addendum extending rearwardly from said trailing edge, said addendum having a front surface facing generally in the same direction as said positive pressure surface of said blade and recessed from the latter and forming a transition angle therewith at said trailing edge, wherein the blade area ratio is at least 40%, namely the cummulative area of said positive pressure surfaces of said blades, excluding said front surfaces of said addendums, is at least 40% of the total area of said annulus, and wherein in combination the rake of said blades is 10° to 25°.

8. The invention according to claim 7 consisting of four said blades.

9. The invention according to claim 7 consisting of three said blades, and wherein said blade area ratio is at least 45%.

10. The invention according to claim 7 wherein said blade area ratio is at least 50%.

11. The invention according to claim 7 wherein said blade rake is about 15°.

12. The invention according to claim 7 consisting of four said blades, and wherein said blade area ratio is at least 50%, and wherein said blade rake is about 15°.

13. A marine propeller comprising a hub having a plurality of blades extending generally radially outwardly therefrom to respective outer tips, each blade having a positive pressure surface with a forward leading edge and a rearward trailing edge, each blade having an integral addendum extending rearwardly from said trailing edge, said addendum having a front surface facing generally in the same direction as said positive pressure surface of said blade and recessed from the latter and forming a transition angle therewith at said trailing edge, said addendum having a rounded nonsharp trailing edge spaced rearwardly of said trailing edge of said positive pressure surface of said blade, wherein said outer tips of said blades define a circle during rotation of said propeller, said circle having a circumference spaced radially outwardly of said hub by an annulus through which said blades move, said annulus having an outer circumference at said blade tips defining said circumference of said circle, said annulus having an inner circumference at inner root ends of said blades where they meet said hub, and wherein the blade area ratio is at least 40%, namely the cumulative area of said positive pressure surfaces of said blades, excluding said front surfaces of said addendums, is at least 40% of the total area of said annulus, and wherein in combination the rake of said blades is 10° to 25°.

* * * * *